US007032511B2

(12) United States Patent
Pudark et al.

(10) Patent No.: US 7,032,511 B2
(45) Date of Patent: Apr. 25, 2006

(54) FOUNTAIN INK FEED SYSTEM

(75) Inventors: Arthur Pudark, Downers Grove, IL (US); Lyle Goodwin, Arlington Heights, IL (US)

(73) Assignee: A.B. Dick Company, Niles, IL (US)

( * ) Notice: Subject to any disclaimer, the term of this patent is extended or adjusted under 35 U.S.C. 154(b) by 147 days.

(21) Appl. No.: 10/815,538

(22) Filed: Apr. 1, 2004

(65) Prior Publication Data

US 2004/0206259 A1 Oct. 21, 2004

Related U.S. Application Data

(60) Provisional application No. 60/463,486, filed on Apr. 16, 2003.

(51) Int. Cl.
*B41F 31/04* (2006.01)

(52) U.S. Cl. ..... 101/365; 101/169

(58) Field of Classification Search ..... 101/364, 101/365, 366, 363, 367, 169, 350.1; 15/256.51
See application file for complete search history.

(56) References Cited

U.S. PATENT DOCUMENTS 3,779,165 A * 12/1973 Abendroth et al. ..... 101/365
3,788,220 A * 1/1974 Laben et al. ..... 101/363
3,922,966 A * 12/1975 Despot ..... 101/350.1
4,089,264 A * 5/1978 Jeschke et al. ..... 101/365
4,159,651 A * 7/1979 MacPhee ..... 74/55
4,366,754 A * 1/1983 Sarda ..... 101/208
4,479,434 A * 10/1984 Armelin ..... 101/365
4,495,864 A * 1/1985 Junghans ..... 101/365
5,031,533 A 7/1991 Goodwin
5,327,830 A * 7/1994 Gelinas et al. ..... 101/363
5,809,887 A * 9/1998 Blackwell et al. ..... 101/350.1
6,076,463 A * 6/2000 Vrotacoe et al. ..... 101/363

* cited by examiner

*Primary Examiner*—Eugene H. Eickholt
(74) *Attorney, Agent, or Firm*—Pearne & Gordon LLP

(57) ABSTRACT

An ink fountain assembly for use in duplicating machines, such as rotary lithographic machines. The assembly comprises a fountain trough defined by an elongated blade and an ink fountain roller defining a gap therebetween. A proximal edge of the blade is rigidly retained and a distal edge of said blade, adjacent said roller, engaging a portion of the frame and being initially flexed and prestressed toward said roller to define the gap. The gap may be varied to control ink flow therethrough.

10 Claims, 5 Drawing Sheets

FOUNTAIN INK FEED SYSTEM

This application claims the benefit of U.S. Provisional Pat. application Ser. No. 60/463,486, the contents of which are incorporated herein by reference.

FIELD OF THE INVENTION

The present invention relates generally to printing machines, and more particularly to an ink fountain assembly and an improved method of controlling ink being fed from a fountain supply to a roller system within the ink fountain assembly.

DESCRIPTION OF THE RELATED ART

Printing machines typically include a printing couple that includes a number of rollers, such as master, blanket-transfer, and impression cylinders and the like. An ink fountain is located in such printing machines for feeding ink to the various rollers of the printing couple which transfers images to copy sheets.

Ink fountain assemblies take the form of a fountain trough defined by an elongated blade extending along one side and an ink fountain roller extending along the opposite side of the trough. The blade is adjustable by a plurality of ink metering screws spaced longitudinally of the blade to vary a gap between an edge of the blade and the ink fountain roller in order to maintain consistency in the amount of ink applied to the roller uniformly or in larger quantities as needed locally along the length of the roller and to adjust the ink fountain setting for a given print job.

The gap maintained between the edge of the blade and the ink fountain roller is important in providing the required quality in printing machine copy. As print orders change, the gap and the required settings should be changed. Printing machine operators require a visual calibration system that is easy to set and an improved precision in the settings.

U.S. Pat. No. 5,031,533 to Goodwin, the contents of which is hereby incorporated by reference, describes a system for setting and calibrating the thumb screws of an ink fountain assembly. The present invention is an improvement to the setting and calibrating system described in the Goodwin '533 patent and further is an improvement to the method of controlling ink being fed from a fountain supply to a roller system.

SUMMARY OF THE INVENTION

An aspect of the present invention is to provide a printing press with improved visual calibration settings that will be easier to set for the press operator, and thereby, requiring reduced skill training of the operator in its operation.

Another aspect of the present invention is to provide a fine metering of ink flow between the fountain blade and the fountain roller. This metering is achievable in fine increments on the order of, e.g., one ten thousandth of an inch.

Another aspect of the present invention is to take digital values from a digital platemaker or image setter and convert those digital values to numerical values in order to visually set each dial on the printing machine to that value.

A final aspect of the present invention is to provide for precise movement of the blade and the elimination of backlash on the ink metering screws. These and other aspects of the present invention will be more fully discussed hereinafter.

DESCRIPTION OF EXAMPLE EMBODIMENTS OF THE INVENTION

Figure 1:
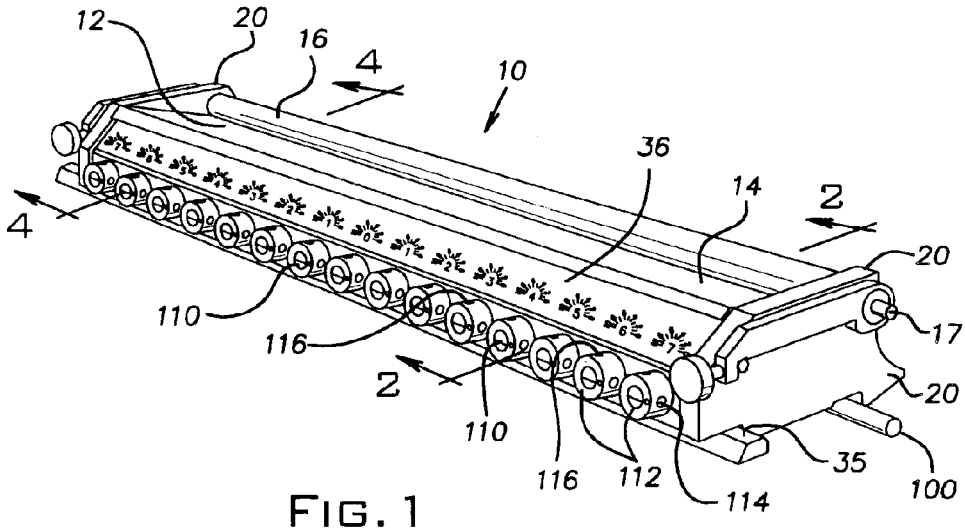
FIG. 1 is a perspective view of an ink fountain assembly according to the present invention.

Referring to FIG. 1, a micro set ink feed assembly 10 as shown includes a fountain trough 12, defined by an elongated blade 14 fixed at one edge to a mounting bar 15 (FIG. 2) and having a free edge extending along one side of the trough and an ink fountain roller 16 integral with shaft 17 extending along the other side of the trough. The blade 14 is mounted on an extruded metal frame or casting 19 (FIG. 2) which frame includes a pair of side plate portions 20.

Figure 2:
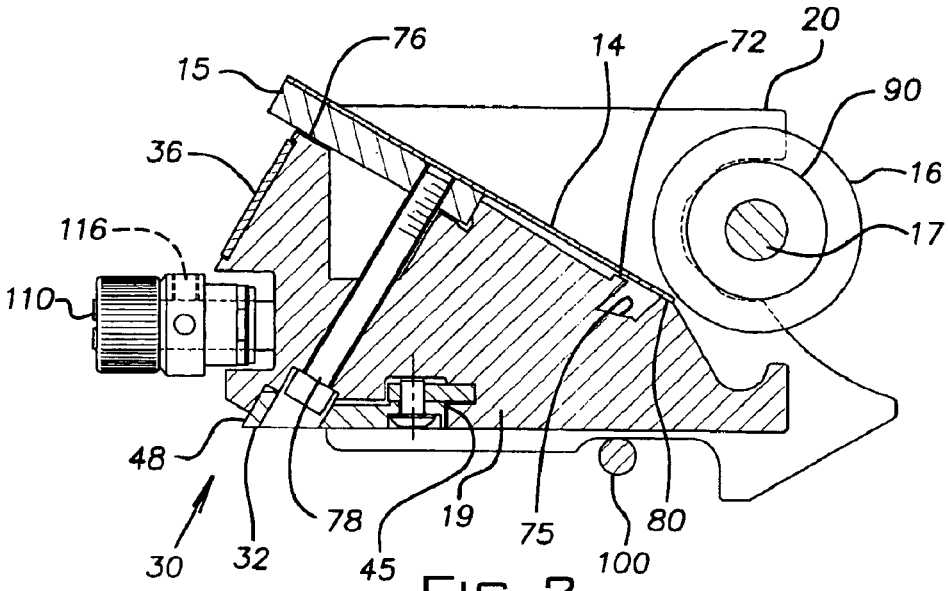
FIG. 2 is a section illustration of the blade assembly of the present invention, the plane of the section being illustrated by the line 2—2 of FIG. 1.

As shown in FIG. 2, when the ink fountain assembly according to this invention is in position on the machine, the blade 14 contacts the frame 19 at its blade tip 80 with a pre-load bend or flex. A space is provided between the mounting bar 15 and a shelf 76. When a fastening screw 78 is tightened, it causes the blade 14 to bend as the bar 15 is drawn toward the shelf 76 to produce the pre-load flex of the blade 14. As will be discussed, the final setting of the metering screws 26 (see, e.g. FIG. 4) also produces, for example, additional pre-load flex of the blade 14. This pre-loading flex of the blade 14 is necessary to cause the blade 14 to respond to the metering screws 26 for each of their zones (FIG. 1) in the ink fountain assembly. The pre-load flex can vary depending on the material used, the thickness, the stiffness, and grain direction of the blade 14.

Figure 4:
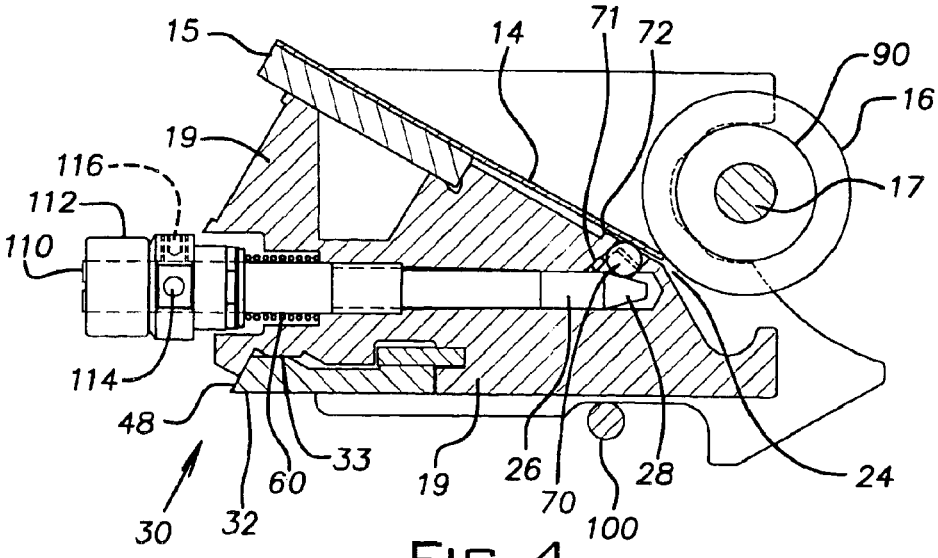
FIG. 4 is a section illustration of an aspect of the improved adjustment method of the present invention, the plane of the section being illustrated by the line 4—4 of FIG. 1.

FIG. 4 shows a section through the ink fountain assembly incorporating the improved design of the present invention. The improved design provides for the distal end of the metering screw 28 to contact a hardened roller 70, and for the hardened roller 70 to contact the blade 14, providing a gap 24. A hardened roll spacer strip 71 is used to position each of the hardened rollers 70 in their respective zones (FIG. 1) along the ink fountain assembly.

Figure 3:
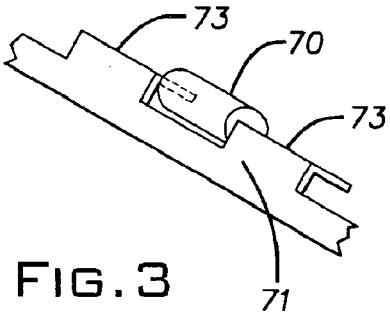
FIG. 3 is a perspective fragmentary illustration of a hardened roller employed in the present invention.

As may be seen in FIG. 3, a spacing strip 71 has projections 73 to separate the hardened rollers 70 which are positioned in a slot 75 (FIG. 2) in the fountain base. The strip 71 keeps each hardened roller 70 positioned in proper relation to the centerline of the dial zones (FIG. 1). The strip 71 speeds assembly and/or disassembly for fountain cleaning, lubricating, or parts replacement. The strip 71 additionally allows the frame 19 an uninterrupted groove configuration which can easily be extruded or machined. The groove may be filled with grease, or similar substance, which lubricates the parts and provides an uninterrupted barrier to ink migration under the blade 14.

Referring again to FIG. 4, the improved design also includes an anti-backlash feature using a heavy duty compression spring 60 that consistently biases a shaft on the metering screw 26 in one direction. The spring 60 keeps the ink metering screw 26 in consistent thread engagement, and, with blade preload, maintains a constant relationship with the hardened roller 70, the ink fountain blade 14, and the ink roller 16.

The improved design of the present invention includes a metering screw 26 containing a threaded section. A conical end 28 of the metering screw 26 and its adjacent diameter, which fits precisely in the frame's pilot hole at that point, are hardened to ensure long life and precise, consistent results. Because the end 28 is closely supported to eliminate deflection of the screw 26 and the motion of its end 28 by external forces by an operator at end 110, the position of end 28 usually does not vary, and precision is thereby maintained. Also, the improved design includes a small overhang from the support contact point of the hardened roller 70 to the blade tip 80, limiting flex and variability.

The hardened roller 70 as shown in FIGS. 3 and 4, makes even contact with the segments of the flexible ink fountain blade 14, thereby effecting linear variation less than, e.g., 0.0001 of an inch amounts in the respective segments of the blade 14. This variation is constant in closing or opening the gap 24 between blade 14 and ink fountain roller 16 while controlling the ink flow in very precise amounts, with controlled adjustments as small as, e.g., 0.0003 of an inch for half dial increments of the sleeve 112. The design as shown in FIG. 4 can produce the positive ink metering of the present invention in very fine amounts by the mechanical advantage of the screw motion with respect to its conical wedge action on the hardened roller 70, the ramping angle of the groove, and the blade's angular relationship with the roller. In an example embodiment, one half turn of a ⅜-24 screw with 15° conical end, 45° groove angle, and 30° blade angle moves the blade 0.006 inch. For each of 10 graduated calibration marks, blade motion equals 0.0006 inch, with 0.0003 motion when set between calibration marks. It is to be understood that other parameters are possible.

Figure 5:
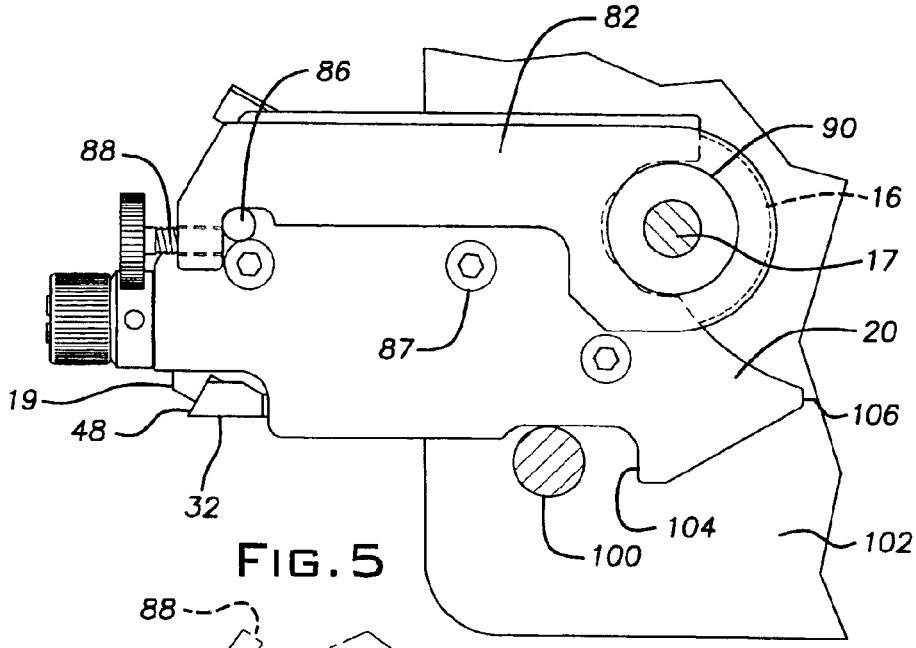
FIG. 5 is a section illustration of the zero tolerance ink fountain lock up feature of the present invention.

Referring now to FIG. 5, the present invention includes a zero tolerance lock-up system that eliminates the tolerances associated with conventional mounting methods. Lock-up arms 82 are attached and pivotable to the fountain roller shaft bearing housing 90. The lock-up arms 82 swing down about the bearing housing 90 contacting a lock-up pin 86 mounted on each of the side plate portions 20 and into the frame 19. When a lock-up thumb screw 88 is tightened, all manufacturing tolerances which would cause mounting variations between the side plate 20 and the bearing housing 90 are removed. The lock-up feature results in a repeatable zero tolerance relationship between the ink fountain roller 16 and the blade 14 (FIG. 4).

Figure 6:
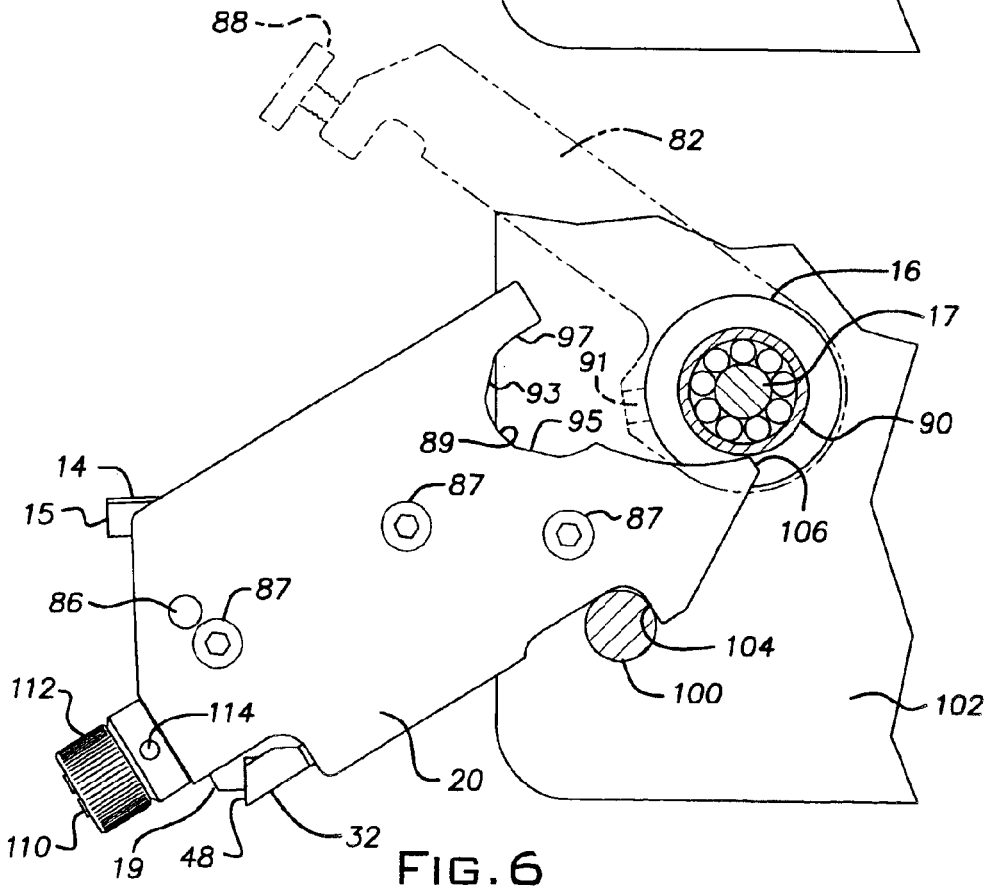
FIG. 6 is a section illustration of the swing down fountain design with lift-off according to the present invention.

The lock-up arms 82 are mounted to and pivot about the fountain roll bearing housing 90. The lock-up arms 82 are held initially in the raised position by, e.g., friction from a nylon tipped set screw 91 against the bearing housing 90 (FIG. 6). When rotated downward over the lock-up pins 86 and secured with the thumbscrews 88, the position of the fountain blade to the fountain roll can be precisely set with manufacturing and assembly tolerances removed insuring a positive repeatable lock-up during the life of the product. The pivot type fountain and side plates permit the use of various types of blades, blade materials and blade construction, such as laser cut or relief grooves in the backside of the blade, and the like.

Referring now to FIG. 6, where the ink fountain side plates 20 have recesses 89 which contact the bearing housing 90. The design of the contact point between the recess 89 and the bearing housing 90 provides a two point "v" shaped contact formed by flat chordal areas 93 and 95 of each side plate 20 eliminating mounting variations.

In addition, the present invention includes pivot type fountain end plates 20 that are able to rotate about a fixed point, e.g., lock-up pin 86. This end plate design with respect to the fountain base and related component allows positioning of the blade 14 to the ink fountain roller 16 when mounted on a machine or when in a fixture removed from the printing machine. Assembly screws 87 then lock in place the end plates 20.

Figure 7:
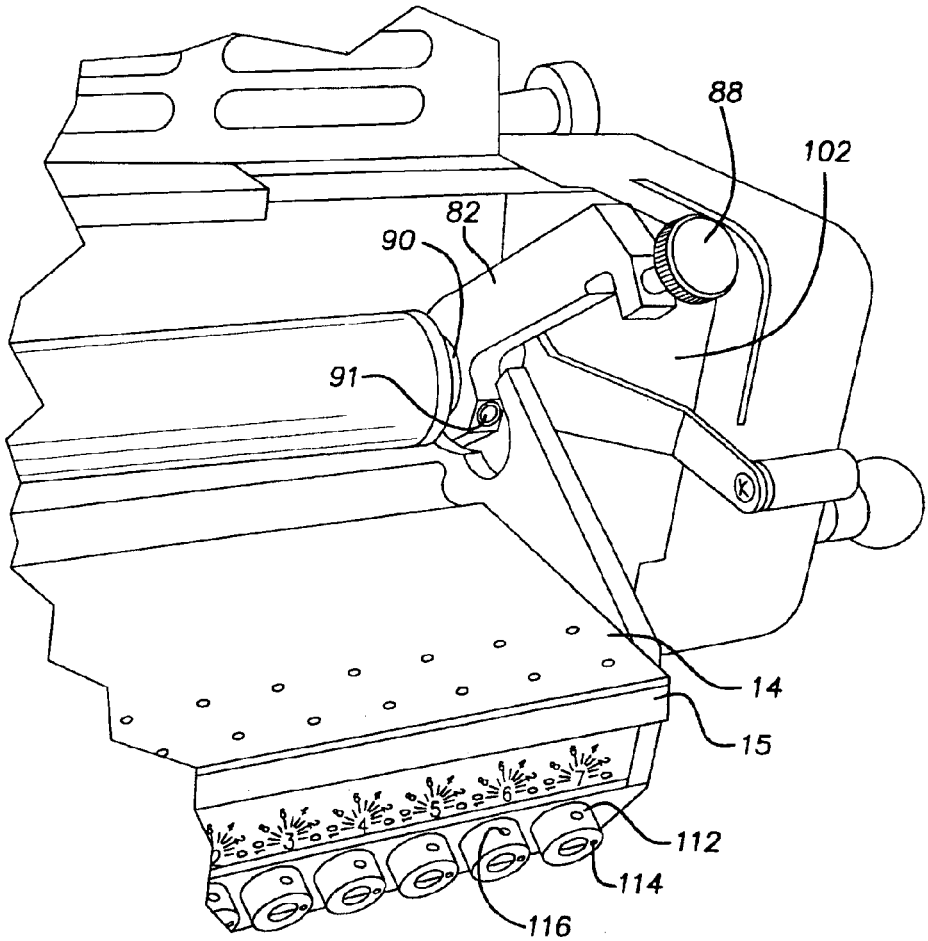
FIG. 7 is a perspective view illustration of the swing down fountain design with lift-off according to the present invention.

Referring now to FIGS. 6 and 7, the present invention includes a swing down fountain design with lift-off. Often conventional fountains are permanently fixed and cannot be removed for cleaning or are not interchangeable. The swing down fountain of the present invention with lift-off allows the operator access for cleaning or to have a multitude of fountains for different colors of ink available for installation. The combination of a swing down fountain with lift-off is beneficial as it permits the immediate installation of a clean fountain during the wash up process.

In its normal operating position, illustrated in FIG. 5, the end plates 20 rest on a cross-bar 100 extending between side plates 102 of the printing press. To swing down the fountain to the position illustrated in FIG. 6, the thumb screw 88 is loosened and the lock up arms 82 are raised to the position outlined in phantom lines. The frame 19 may then be tilted down to the solid outline position so that abutment portions 104 of the side plates 20 engage the cross-bar 100 and nose portions 106 of the side plates engage the bearing housing 90. To remove the fountain assembly from the printing press for cleaning or to install a different fountain, etc., the fountain assembly is pivoted clockwise, as viewed in FIG. 6, so that the abutment portions clear the cross bar 100, and is then pulled away from the printing press.

The present invention may also include a pre-set blade feature. When the blade 14 is assembled to the fountain base, as previously discussed, an intentional blade flex between the frame 19 (FIG. 2) and the blade 14 is incorporated into the blade 14. This intentional flex removes the need to initially load the blade 14 via the metering screw configuration. Such prestressing stabilizes and overcomes internal stresses set up in the blade during the blade machining, finishing and welding process. The prestressing also limits the travel and the adjustment range needed to meter ink by allowing closer proximity of the blade 14 to the ink roller prior to final adjustment. Additionally, the gap between the blade 14 and its initial resting point 80 is quite narrow limiting ink migration under the blade 14.

The pre-set blade assembly of the present invention requires a specific method of installation that will now be described. Metering screws 110 (FIG. 1) with springs 60 (FIG. 4) are installed with a screwdriver. The outermost metering screws 110 numbered, for ease of illustration, 7 and 7 on the front face of the ink feed assembly as shown in FIG. 1, are threaded inwardly until the hardened rolls 70 contact the blade 14. Then the screws 110 are turned the same number of turns, for example, one and one-half turn. This position relates to an adjustment of 0.018 of an inch. If the gap between the mounting bar 15 and shelf 76 were 0.024 of an inch, the pre-load total would be set on the blade to 0.042 of an inch. Setting the two end metering screws 110 as described positions the blade 14 to an equivalent zero ink feed position. The blade can now be aligned against the ink fountain roller in the printing machine or in an equivalent fixture for final positioning of the end plates 20. The other metering screws 110 are then set to the same blade-to-roll contact. Metering screw sleeves 112 (FIG. 1) with dial indicators 114 on the outer face and on the periphery of the sleeves 112 are then installed with the dial indicators 114 set at, e.g., zero in the three o'clock position of the dial-artwork 36 with locking screws 116. It is to be understood that other parameters are possible. It is to be appreciated that dial-artwork 36 may in the alternative include indicating arrows and the sleeve 112 may have engraved thereon digits, e.g., 0–10, and calibration marks instead of the indicator 114.

Figure 8:
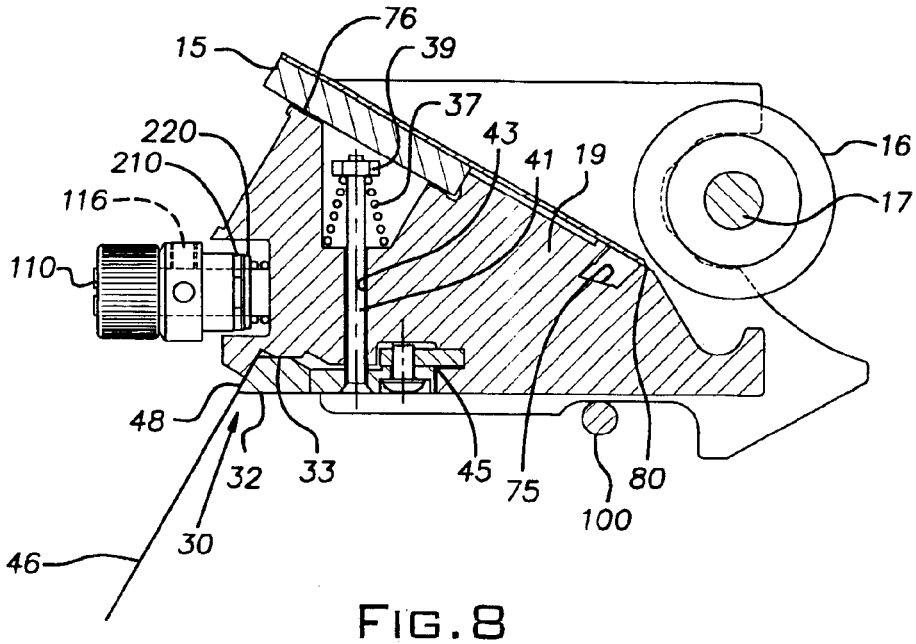
FIG. 8 is a perspective view illustration of the copy holder according to the present invention.

Referring now to FIGS. 4 and 8, a copy holder 30 includes clamping bar 32 which extends laterally within a pocket 33 in the base casting 19 and has laterally projecting wings 35 (FIG. 1). The clamping bar 32 is biased against the pocket 33 by a spring 37 acting between the casting 19 and a nut 39 provided at one end of a screw 41. The other end of the screw 41 sits and pivots in the clamping bar 32, while the shank of the screw 41 slides freely in a passage 43. By pushing one or both wings 35 downwardly, the bar 32 pivots about pivot point 45 against the bias of the spring 37 to open a small gap between the casting 19 and a lip 48 at the rear edge of the clamping bar 32. This applies clamping force evenly across the length of the fountain assembly 10 when actuated by one hand at either end. The function of this feature in the present invention is to take one of the first printed sheets 46 from the printing machine, which can be folded in half to quickly locate the centerline of the sheet 46, and insert it into the copyholder 30. The proof sheet is slid sideways until the centerline of the sheet aligns with the center of the center dial 36. This alignment of the proof sheet makes it easy to calibrate the dial setting for ink flow and its proper alignment. The copyholder 30 can also hold a digitally produced chart with numerical values relating to the proper ink flow dial setting or a chart with values entered by an operator.

Figure 9:
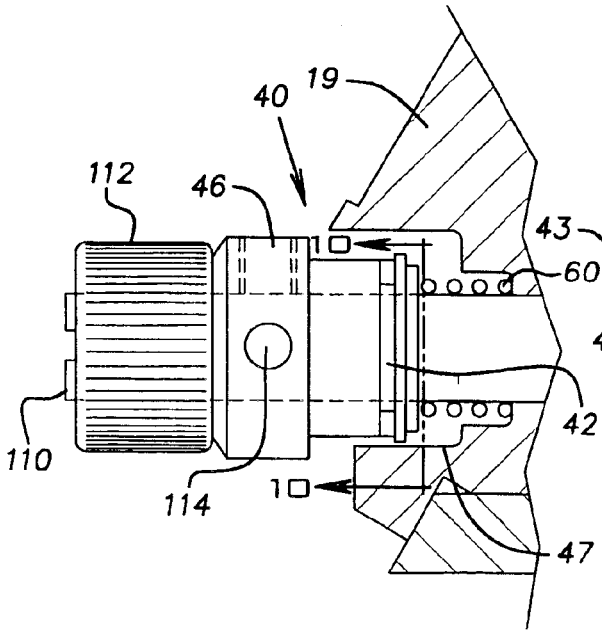
FIG. 9 is a side view illustration of the integral dial stop according to the present invention.
Figure 10:
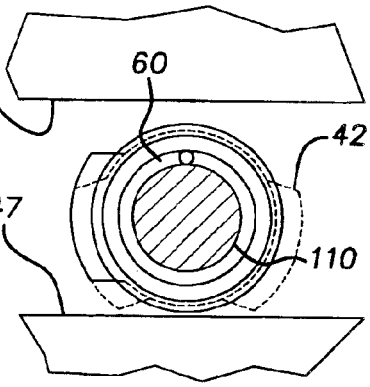
FIG. 10 is a front illustration of the integral dial stop according to the present invention.

FIGS. 9 and 10 illustrate the integral dial stop 42, which is fixed to each metering screw sleeve 112. The dial stop 42 limits both the open and closed position of the metering screws since a shelf 47 in the casting 19 interferes with full rotation of the dial stop and limits rotation thereof to slightly more than 180°. The slight overtravel at either end of the 180° range increases the rotatability range of the dial at both the open and closed positions to allow for more ink or a tighter off-condition. This also permits the dial locking screw 46 to be located in position for easy access and visibility.

Although the invention has been shown and described with respect to certain embodiments, it is obvious that alterations and modifications will occur to others skilled in the art upon reading and understanding the specification. The present invention is intended to include all such alterations and modifications.

What is claimed is:

1. An ink fountain assembly for use in duplicating machines, such as rotary offset lithographic machines, comprising a fountain trough defined by an elongated blade and an ink fountain roller defining a gap there between, a proximal edge of said blade being rigidly retained and a distal edge of said blade, adjacent said roller, engaging a portion of a frame and being initially flexed and prestressed toward said roller to define said gap, and means to vary the gap and the ink flow therethrough.

2. An ink fountain assembly according to claim 1 wherein said means to vary the gap includes a plurality of metering screws which apply additional flexure to said blade.

3. An ink fountain assembly according to claim 2 wherein a hardened roller is interposed between each metering screw and said blade.

4. An ink fountain assembly according to claim 3 wherein said hardened rollers are provided in a slot in said frame and are separated by a spacing strip.

5. An ink fountain assembly according to claim 1 wherein the proximal edge of said blade is fixed to a mounting bar and means to vary the position of said mounting bar relative to the frame to thereby vary the initial flex and prestress of said blade.

6. An ink fountain assembly according to claim 1 wherein said fountain trough is further defined by ink fountain side plates, said ink fountain roller being mounted in bearings at its end, a lock-up arm functionally mounted on each bearing, each lock-up arm being pivotally moveable from a first raised position to a locked position, said side plates having recessed end portions engaging said bearings and having projections engaged by each lock-up arm when said arm is in its locked position, a screw threaded through a portion of each lock up arm and engaging each projection to take up manufacturing and assembly tolerances and precisely set the blade relative to the fountain roller.

7. An ink fountain assembly according to claim 6 wherein said recessed end portions have flat chordal areas which provide a two point V-shaped contact with the bearing.

8. An ink fountain assembly according to claim 6 wherein said side plates rest on a cross-bar extending between side plates of a duplicating machine and the fountain assembly is removably attached to said duplicating machine by said cross bar and the recessed end portions of said side plates.

9. An ink fountain assembly according to claim 1 including clamping means to clamp a proof sheet across the length of said fountain assembly.

10. An ink fountain assembly according to claim 9 wherein said clamping means comprises a spring biased clamping bar extending laterally within a pocket in said frame.

* * * * *